US010565806B2

(12) United States Patent
Rockwell et al.

(10) Patent No.: US 10,565,806 B2
(45) Date of Patent: Feb. 18, 2020

(54) METHOD AND APPARATUS FOR VEHICLE WARNING LIGHT HANDLING

(71) Applicant: Ford Global Technologies, LLC, Dearborn, MI (US)

(72) Inventors: Mark Anthony Rockwell, Wyandotte, MI (US); Douglas Raymond Martin, Canton, MI (US)

(73) Assignee: For Global Technologies, LLC, Dearborn, MI (US)

( * ) Notice: Subject to any disclaimer, the term of this patent is extended or adjusted under 35 U.S.C. 154(b) by 825 days.

(21) Appl. No.: 14/630,760

(22) Filed: Feb. 25, 2015

(65) Prior Publication Data

US 2016/0247333 A1 Aug. 25, 2016

(51) Int. Cl.
*G07C 5/08* (2006.01)
*G07C 5/00* (2006.01)

(52) U.S. Cl.
CPC ..... *G07C 5/0808* (2013.01); *G07C 5/0816* (2013.01); *G07C 5/008* (2013.01); *G07C 5/085* (2013.01)

(58) Field of Classification Search
CPC .... G07C 5/0825; G07C 5/008; G07C 5/0808; G07C 5/085; G07C 5/006–008; G07C 5/0816–0833; G07C 5/0841–0891; B60R 25/10; B60R 25/102; B60R 25/2018; B60R 2225/00
USPC ..... 701/31.5, 29.2, 31.4, 31.6, 31.7, 31.8, 701/32.7, 33.2, 33.3; 340/425.5, 426.18, 340/438
See application file for complete search history.

(56) References Cited

U.S. PATENT DOCUMENTS

| | | | | |
|---|---|---|---|---|
| 6,028,537 | A * | 2/2000 | Suman | B60K 35/00 340/426.14 |
| 6,330,499 | B1 | 12/2001 | Chou et al. | |
| 6,493,557 | B1 * | 12/2002 | Yoshida | H04B 7/18532 340/438 |
| 7,920,944 | B2 | 4/2011 | Gould et al. | |
| 8,099,308 | B2 | 1/2012 | Uyeki | |
| 2005/0021200 | A1 * | 1/2005 | Taki | G07C 5/008 701/32.7 |
| 2008/0316009 | A1 * | 12/2008 | Nagata | B60K 35/00 340/438 |
| 2010/0117810 | A1 * | 5/2010 | Hagiwara | G06F 3/0483 340/425.5 |
| 2011/0012720 | A1 | 1/2011 | Hirschfeld | |
| 2012/0123633 | A1 * | 5/2012 | Uyeki | B60L 3/12 701/33.2 |
| 2012/0164989 | A1 * | 6/2012 | Xiao | G07C 5/008 455/414.1 |
| 2013/0204484 | A1 * | 8/2013 | Ricci | G06F 17/00 701/29.4 |

(Continued)

*Primary Examiner* — Bao Long T Nguyen
(74) *Attorney, Agent, or Firm* — Michael Spenner; Brooks Kushman P.C.

(57) ABSTRACT

A system includes a processor configured to detect a vehicle condition associated with a warning light. The processor is also configured to obtain explanatory information explaining the cause of the warning light. The processor is further configured to present the explanatory information via a vehicle display. Also, the processor is configured to present a plurality of options for further action with the explanatory information and, upon selection of one of the options, take further steps in accordance with the selection option.

8 Claims, 5 Drawing Sheets

(56) References Cited

U.S. PATENT DOCUMENTS

| | | | | |
|---|---|---|---|---|
| 2013/0204493 | A1* | 8/2013 | Ricci | G06F 17/00 701/41 |
| 2015/0032607 | A1* | 1/2015 | Chen | G07C 5/008 705/39 |
| 2015/0160029 | A1* | 6/2015 | Kobayashi | G01C 21/3469 701/32.3 |
| 2016/0093210 | A1* | 3/2016 | Bonhomme | G08G 1/0967 340/905 |

* cited by examiner

METHOD AND APPARATUS FOR VEHICLE WARNING LIGHT HANDLING

TECHNICAL FIELD

The illustrative embodiments generally relate to a method and apparatus for vehicle warning light handling.

BACKGROUND

Connected vehicle services, often accessed through infotainment systems using telematics units, provide a user with a variety of on-demand options. Users can connect to applications on a mobile device, stream media and even connect to remote servers. Using in-vehicle systems can avoid having a user reach for a mobile phone to perform an action, but sometimes desired services are not yet provided in vehicle.

For example, if a vehicle warning light goes on, the user may not have an application on a mobile device that addresses vehicle warning light conditions. The user may have to pull over to the side of the road and open an owner's manual to determine a source of trouble. In some instances, a trip to a dealer or mechanic may even be needed.

In one illustrative example, a system and method for vehicle diagnostic and health monitoring includes a client computer device within the vehicle, coupled to the vehicle's monitoring systems, for data management, remote session management and user interaction, a communication system, coupled to the client computer device, for providing remote communication of data including data derived from internal monitoring systems of the vehicle, and a remote service center including a vehicle data store, a server computer, a diagnostic engine, and a communicator for communicating the results of analysis of vehicle information to the client computer device via the communication system.

In another illustrative example, data from the on-board diagnostic system of a vehicle is integrated with data from the sensors contained in a personal communication device or smart phone. The data integration enables improved diagnostic information to be provided to the driver. In addition, data can be distributed to remote systems using the device's network connection for additional analysis and comparison. Remote data can be used in aggregate by third parties or sent back to the driver to further inform driving choices.

SUMMARY

In a first illustrative embodiment, a system includes a processor configured to detect a vehicle condition associated with a warning light. The processor is also configured to obtain explanatory information explaining the cause of the warning light. The processor is further configured to present the explanatory information via a vehicle display. Also, the processor is configured to present a trouble-shooting option in conjunction with the explanatory information and, upon selection of the trouble-shooting option, present a process for trouble-shooting a system causing the warning light.

In a second illustrative embodiment, a system includes a processor configured to detect a vehicle condition associated with a warning light. The processor is also configured to obtain explanatory information explaining the cause of the warning light. The processor is further configured to present the explanatory information via a vehicle display. Also, the processor is configured to present a schedule-repair option in conjunction with the explanatory information. The processor is additionally configured to determine at least one repair location for repairing a system causing the warning light and, upon selection of the schedule-repair option, provide scheduling assistance with the at least one repair location.

In a third illustrative embodiment, a system includes a processor configured to detect a vehicle condition associated with a warning light. The processor is also configured to obtain explanatory information explaining the cause of the warning light. The processor is further configured to present the explanatory information via a vehicle display. Also, the processor is configured to present a data-transfer option in conjunction with the explanatory information and, upon selection of the data-transfer option, transfer data relating to a system causing the warning light to a mobile device.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
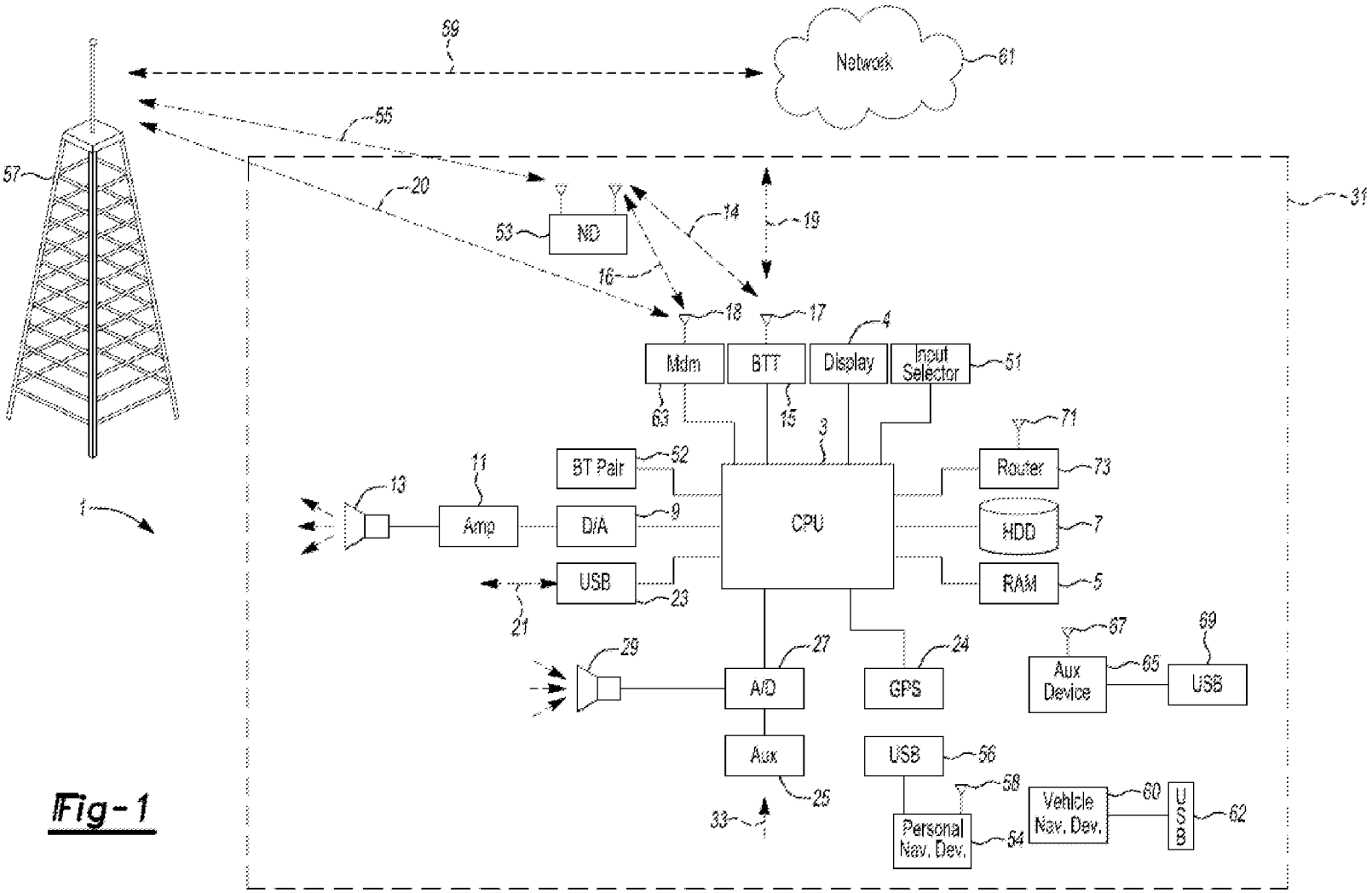
FIG. 1 shows an illustrative vehicle computing system.

FIG. 1 illustrates an example block topology for a vehicle based computing system 1 (VCS) for a vehicle 31. An example of such a vehicle-based computing system 1 is the SYNC system manufactured by THE FORD MOTOR COMPANY. A vehicle enabled with a vehicle-based computing system may contain a visual front end interface 4 located in the vehicle. The user may also be able to interact with the interface if it is provided, for example, with a touch sensitive screen. In another illustrative embodiment, the interaction occurs through, button presses, spoken dialog system with automatic speech recognition and speech synthesis.

In the illustrative embodiment 1 shown in FIG. 1, a processor 3 controls at least some portion of the operation of the vehicle-based computing system. Provided within the vehicle, the processor allows onboard processing of commands and routines. Further, the processor is connected to both non-persistent 5 and persistent storage 7. In this illustrative embodiment, the non-persistent storage is random access memory (RAM) and the persistent storage is a hard disk drive (HDD) or flash memory. In general, persistent (non-transitory) memory can include all forms of memory that maintain data when a computer or other device is powered down. These include, but are not limited to, HDDs, CDs, DVDs, magnetic tapes, solid state drives, portable USB drives and any other suitable form of persistent memory.

The processor is also provided with a number of different inputs allowing the user to interface with the processor. In this illustrative embodiment, a microphone 29, an auxiliary input 25 (for input 33), a USB input 23, a GPS input 24, screen 4, which may be a touchscreen display, and a BLUETOOTH input 15 are all provided. An input selector 51 is also provided, to allow a user to swap between various inputs. Input to both the microphone and the auxiliary connector is converted from analog to digital by a converter 27 before being passed to the processor. Although not shown, numerous of the vehicle components and auxiliary components in communication with the VCS may use a vehicle network (such as, but not limited to, a CAN bus) to pass data to and from the VCS (or components thereof).

Outputs to the system can include, but are not limited to, a visual display 4 and a speaker 13 or stereo system output. The speaker is connected to an amplifier 11 and receives its signal from the processor 3 through a digital-to-analog converter 9. Output can also be made to a remote BLUETOOTH device such as PND 54 or a USB device such as vehicle navigation device 60 along the bi-directional data streams shown at 19 and 21 respectively.

In one illustrative embodiment, the system 1 uses the BLUETOOTH transceiver 15 to communicate 17 with a user's nomadic device 53 (e.g., cell phone, smart phone, PDA, or any other device having wireless remote network connectivity). The nomadic device can then be used to communicate 59 with a network 61 outside the vehicle 31 through, for example, communication 55 with a cellular tower 57. In some embodiments, tower 57 may be a WiFi access point.

Exemplary communication between the nomadic device and the BLUETOOTH transceiver is represented by signal 14.

Pairing a nomadic device 53 and the BLUETOOTH transceiver 15 can be instructed through a button 52 or similar input. Accordingly, the CPU is instructed that the onboard BLUETOOTH transceiver will be paired with a BLUETOOTH transceiver in a nomadic device.

Data may be communicated between CPU 3 and network 61 utilizing, for example, a data-plan, data over voice, or DTMF tones associated with nomadic device 53. Alternatively, it may be desirable to include an onboard modem 63 having antenna 18 in order to communicate 16 data between CPU 3 and network 61 over the voice band. The nomadic device 53 can then be used to communicate 59 with a network 61 outside the vehicle 31 through, for example, communication 55 with a cellular tower 57. In some embodiments, the modem 63 may establish communication 20 with the tower 57 for communicating with network 61. As a non-limiting example, modem 63 may be a USB cellular modem and communication 20 may be cellular communication.

In one illustrative embodiment, the processor is provided with an operating system including an API to communicate with modem application software. The modem application software may access an embedded module or firmware on the BLUETOOTH transceiver to complete wireless communication with a remote BLUETOOTH transceiver (such as that found in a nomadic device). Bluetooth is a subset of the IEEE 802 PAN (personal area network) protocols. IEEE 802 LAN (local area network) protocols include WiFi and have considerable cross-functionality with IEEE 802 PAN. Both are suitable for wireless communication within a vehicle. Another communication means that can be used in this realm is free-space optical communication (such as IrDA) and non-standardized consumer IR protocols.

In another embodiment, nomadic device 53 includes a modem for voice band or broadband data communication. In the data-over-voice embodiment, a technique known as frequency division multiplexing may be implemented when the owner of the nomadic device can talk over the device while data is being transferred. At other times, when the owner is not using the device, the data transfer can use the whole bandwidth (300 Hz to 3.4 kHz in one example). While frequency division multiplexing may be common for analog cellular communication between the vehicle and the internet, and is still used, it has been largely replaced by hybrids of Code Domain Multiple Access (CDMA), Time Domain Multiple Access (TDMA), Space-Domain Multiple Access (SDMA) for digital cellular communication. These are all ITU IMT-2000 (3G) compliant standards and offer data rates up to 2 mbs for stationary or walking users and 385 kbs for users in a moving vehicle. 3G standards are now being replaced by IMT-Advanced (4G) which offers 100 mbs for users in a vehicle and 1 gbs for stationary users. If the user has a data-plan associated with the nomadic device, it is possible that the data-plan allows for broad-band transmission and the system could use a much wider bandwidth (speeding up data transfer). In still another embodiment, nomadic device 53 is replaced with a cellular communication device (not shown) that is installed to vehicle 31. In yet another embodiment, the ND 53 may be a wireless local area network (LAN) device capable of communication over, for example (and without limitation), an 802.11g network (i.e., WiFi) or a WiMax network.

In one embodiment, incoming data can be passed through the nomadic device via a data-over-voice or data-plan, through the onboard BLUETOOTH transceiver and into the vehicle's internal processor 3. In the case of certain temporary data, for example, the data can be stored on the HDD or other storage media 7 until such time as the data is no longer needed.

Additional sources that may interface with the vehicle include a personal navigation device 54, having, for example, a USB connection 56 and/or an antenna 58, a vehicle navigation device 60 having a USB 62 or other connection, an onboard GPS device 24, or remote navigation system (not shown) having connectivity to network 61. USB is one of a class of serial networking protocols. IEEE 1394 (FireWire™ (Apple), i.LINK™ (Sony), and Lynx™ (Texas Instruments)), EIA (Electronics Industry Association) serial protocols, IEEE 1284 (Centronics Port), S/PDIF (Sony/Philips Digital Interconnect Format) and USB-IF (USB Implementers Forum) form the backbone of the device-device serial standards. Most of the protocols can be implemented for either electrical or optical communication.

Further, the CPU could be in communication with a variety of other auxiliary devices 65. These devices can be connected through a wireless 67 or wired 69 connection. Auxiliary device 65 may include, but are not limited to, personal media players, wireless health devices, portable computers, and the like.

Also, or alternatively, the CPU could be connected to a vehicle based wireless router 73, using for example a WiFi (IEEE 803.11) 71 transceiver. This could allow the CPU to connect to remote networks in range of the local router 73.

In addition to having exemplary processes executed by a vehicle computing system located in a vehicle, in certain embodiments, the exemplary processes may be executed by a computing system in communication with a vehicle computing system. Such a system may include, but is not limited to, a wireless device (e.g., and without limitation, a mobile phone) or a remote computing system (e.g., and without limitation, a server) connected through the wireless device. Collectively, such systems may be referred to as vehicle associated computing systems (VACS). In certain embodiments particular components of the VACS may perform particular portions of a process depending on the particular implementation of the system. By way of example and not limitation, if a process has a step of sending or receiving information with a paired wireless device, then it is likely that the wireless device is not performing that portion of the process, since the wireless device would not "send and receive" information with itself. One of ordinary skill in the art will understand when it is inappropriate to apply a particular computing system to a given solution.

In each of the illustrative embodiments discussed herein, an exemplary, non-limiting example of a process performable by a computing system is shown. With respect to each process, it is possible for the computing system executing the process to become, for the limited purpose of executing the process, configured as a special purpose processor to perform the process. All processes need not be performed in their entirety, and are understood to be examples of types of processes that may be performed to achieve elements of the invention. Additional steps may be added or removed from the exemplary processes as desired.

Customers can receive a myriad of warning lights on an instrument panel that indicate something may be wrong with a vehicle. Without a trip to the dealership, a mechanic, or ownership of a sophisticated diagnostic tool, however, it is often impossible for the customer to know why the warning light is lit. While the light may provide limited information, the actual cause of the light may not be apparent (e.g., check engine light). Also, the customer may have limited or no information as to what actions can be taken to address the light.

Using a telematics control unit in communication with a remote server and center stack or cluster display, the illustrative embodiments may provide a display that explains the reason for a lit warning light. Accompanying this information may be, for example, further customer actions (troubleshooting), repair facilitation (recommendations, scheduling options) and the ability to transfer the associated information to a mobile device (where it can be shown to another person, accessed by a troubleshooting or advice application, etc.).

Figure 2:
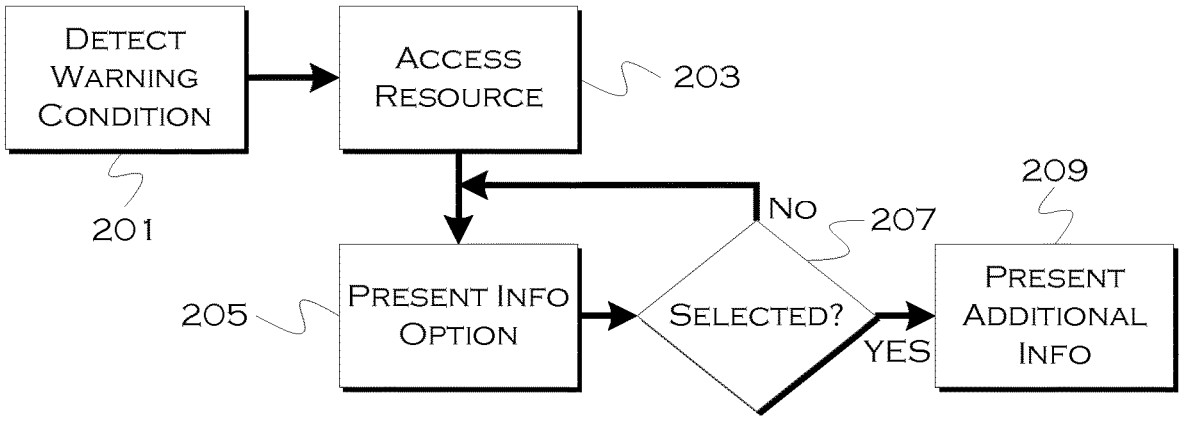
FIG. 2 shows an illustrative process for warning light information provision.

FIG. 2 shows an illustrative process for providing warning light information. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

FIG. 2 shows a fairly high-level process with possible steps for an illustrative system to take when a warning light is illuminated. In this example, the process detects a warning condition. When the light is lit, there is typically information available on a vehicle BUS that corresponds to some trouble condition. This information causes the light to be lit, and may be accessed by a diagnostic tool to determine the reason for the light.

In this example, the process will detect the warning condition associated with the light 201 and access a vehicle resource 203. The resource provides additional information and/or recommended actions to be taken with respect to the light. The information may be stored locally or, in another example, stored remotely on the cloud. Based on this information, one or more options may be presented 205 for user selection. These can include, but are not limited to, troubleshoot the problem, contact a dealer or schedule maintenance, and transfer the warning information to a user mobile device.

When one of these options is selected 207, the process will present additional information 209 relating to the selected option. For example, troubleshooting option selection could result in display of steps to troubleshoot the problem. Contact a dealer could result in display of one or more recommended service centers with an option to call the dealer. Transfer of data could result in display of one or more mobile devices to which the information could be transferred.

Figure 3:
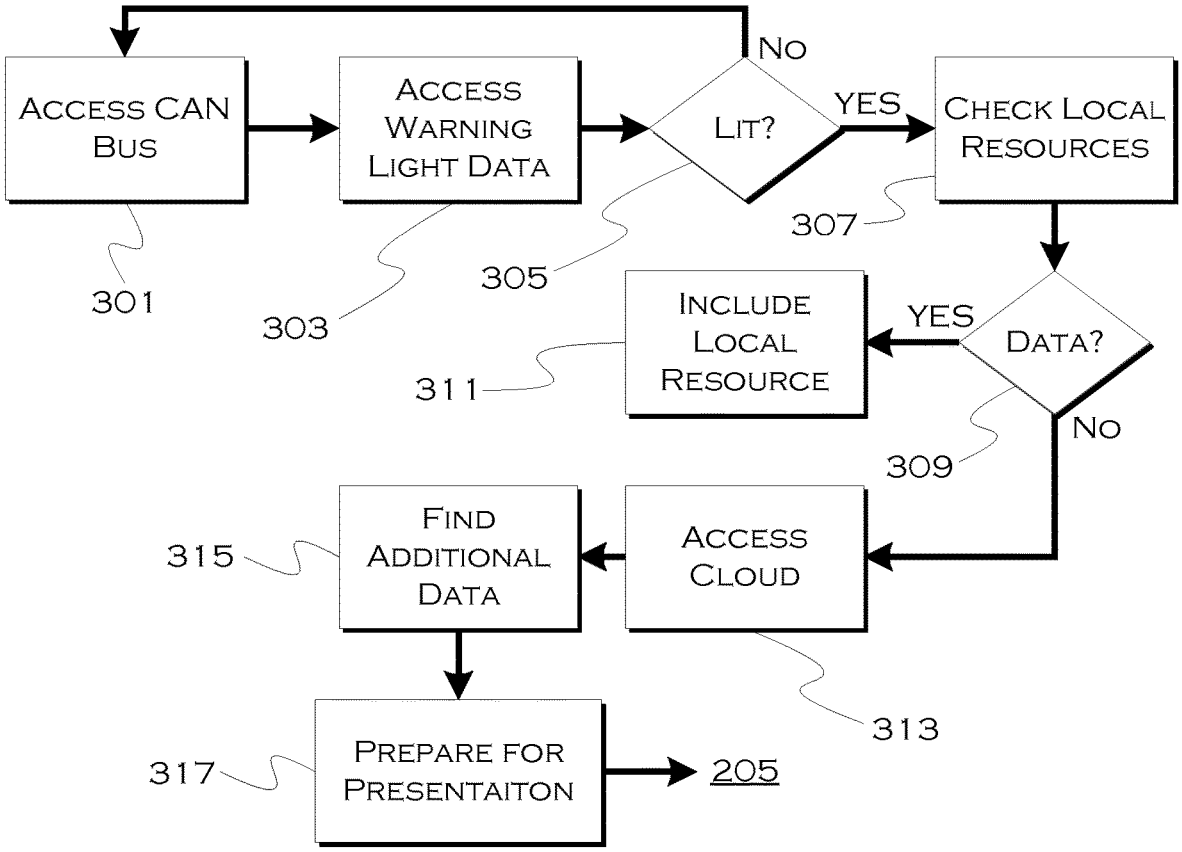
FIG. 3 shows an illustrative information gathering process.

FIG. 3 shows an illustrative information gathering process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

FIG. 3 shows a more detailed version of an exemplary process for gathering data about a warning light and gathering data for user presentation. In this example, the process accesses a controller area network (CAN) BUS or other vehicle network 301. These networks contain data, such as vehicle sensor conditions indicating trouble-states, as well as state data for vehicle warning lights. In this example, the process accesses the trouble-state data and/or warning light data 303 to determine if a problem exists.

If the light is lit 305 (or if trouble exists that would cause a light to be lit), the process may check local resources to see if there is additional information available relating to the problem 307. This information could include, but is not limited to, a digital manual, instructions for responding to the cause of the problem, or any other suitable explanatory information. If there is sufficient or useful data 309, the process will include this data 311 in preparation of an explanatory display of information.

If there is insufficient data, then the process may access the cloud or a remote resource 313 to obtain further data relating to the problem causing the light to be lit. Since these resources are typically more abundant than any local vehicular information, these resources may be accessed regardless of whether or not local data was present. Of course, if a cloud connection is not needed or is not available, this access can be skipped.

Once the remote resources are accessed, a request for additional information could be sent 315. This request could be formatted in accordance with an accessed resource, and will result in additional or new information relating to the detected problem. This information is incorporated with any local information already obtained, and the process can prepare a display including relevant information for user viewing 317. This display is then presented to a vehicle user 205.

Figure 4:
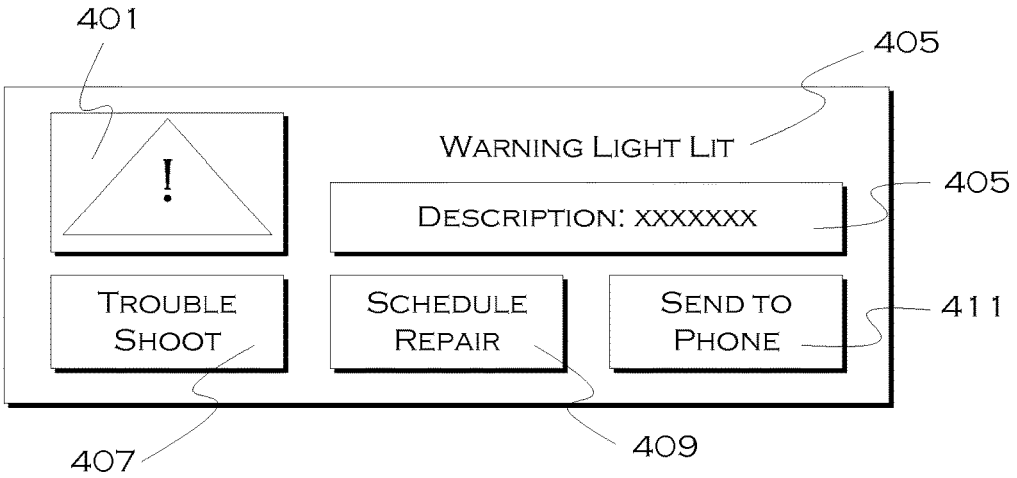
FIG. 4 shows an illustrative vehicle display.

FIG. 4 shows an illustrative vehicle display. This is a simple, non-limiting example of what may be shown on a cluster or center-stack of a vehicle (or, for example, on a mobile device in communication with a vehicle, if no display is present or available). In this example, a representation of the warning light 401 is shown. Accompanying this representation, a warning message 403 and a description of the problem 405 are also shown.

In this example, there are three options the user can take at this point. They include, but are not limited to, troubleshooting the problem 407, scheduling repair to address the problem 409, and sending information relating to the problem to a user mobile device 411. Unavailable options may not be shown or may be greyed out. Other options may also be shown as appropriate (e.g., without limitation—"access manual page," etc.).

Of course, any suitable display may be shown, as appropriate. What is shown is just one non-limiting example of an illustrative display.

Figure 5:
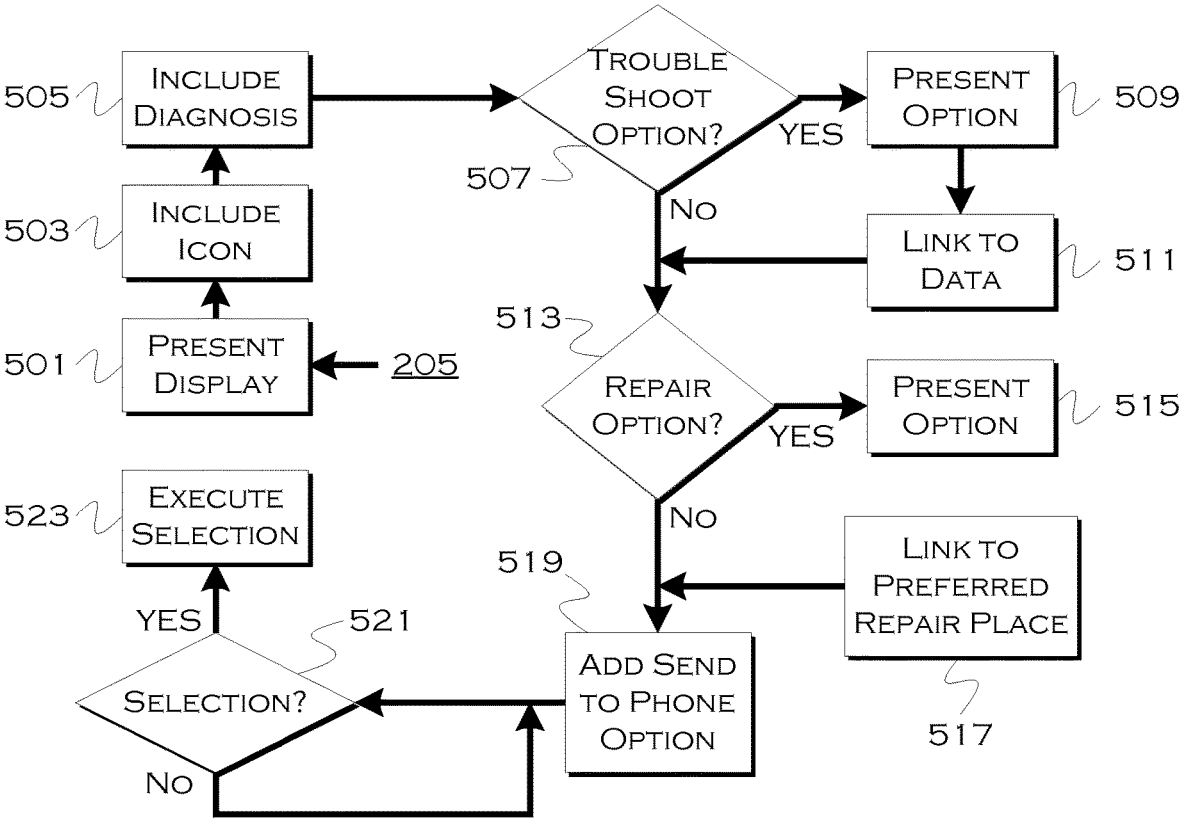
FIG. 5 shows an illustrative further-actions process.

FIG. 5 shows an illustrative further-actions process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this illustrative example, a more detailed display and options handling process is shown. Again, this is for illustrative purposes only, and is not intended to limit the scope of the invention. Here, the display assembly process is shown, wherein the process presents a display related to the warning light 501.

In this example, an icon relating to the warning light is shown 503. This can help a user with multiple warning lights understand which light the information refers to, and also can help notify a user of the existence of a warning light, if the user didn't notice the light. A diagnosis and/or description of the cause of the warning light is also included 503.

The process may also include a troubleshoot option, if appropriate 507. If the option is included, the process may present the option 509 and link the option to data relating to troubleshooting the problem 511. This data may be obtained from the cloud or already stored locally. If appropriate for local storage, the cloud based data may be stored locally for easy provision if the option is selected.

Also, if appropriate, a repair option may be shown 513. If the option is to be shown, the process may display the repair option 515 and link the option to data relating to one or more preferred service centers 517. The process may also add an option to send the data to a mobile device 519, in this example. If this option is selected, the diagnostic data and/or informational data may be sent to a mobile device, for later display or use by an application on the mobile device. Once a selection is made 521, the process may take appropriate steps 523 in accordance with the selected option, such as executing a function associated with the selected option 523.

Figure 6:
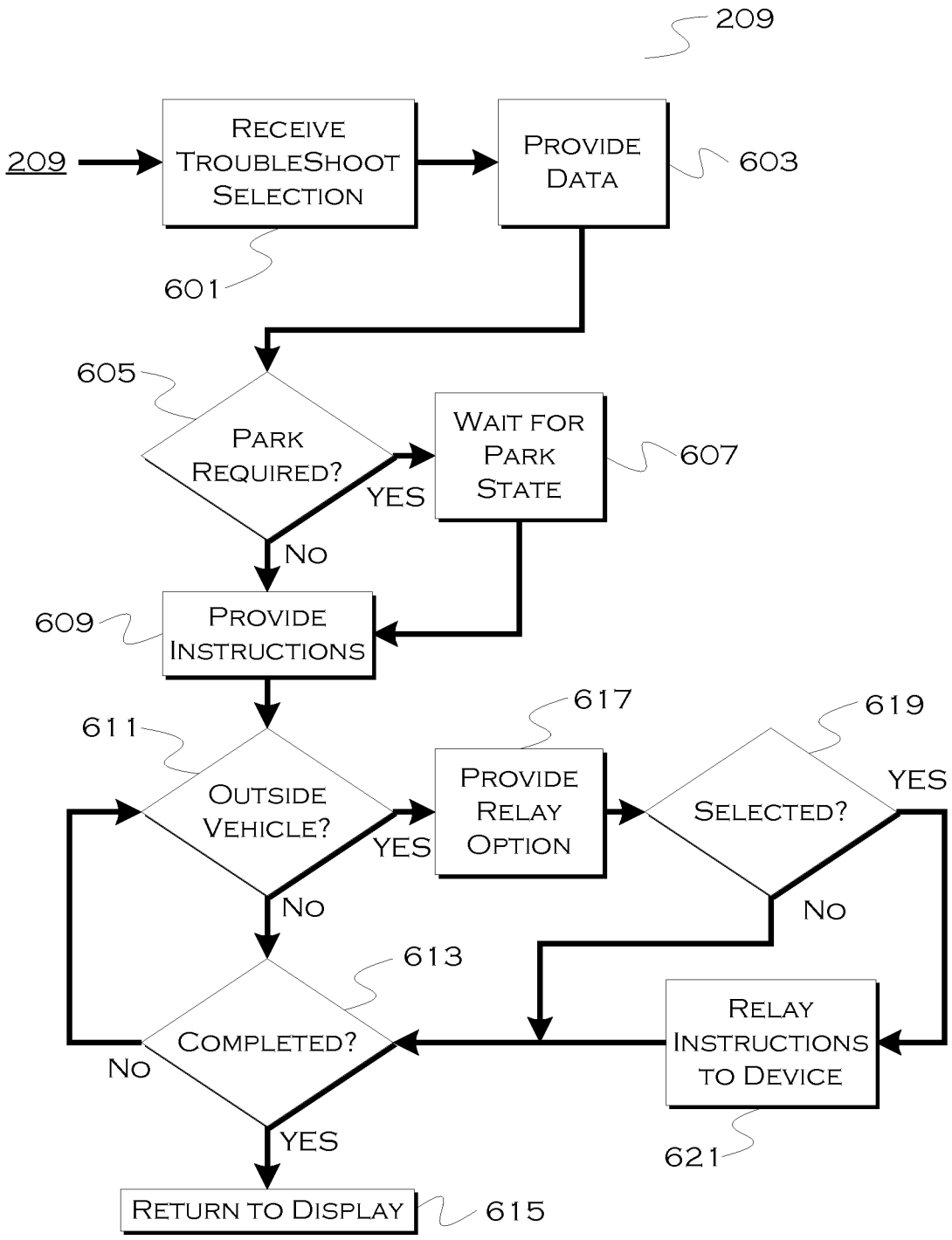
FIG. 6 shows an illustrative troubleshooting process.

FIG. 6 shows an illustrative troubleshooting process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this illustrative example, the process receives selection of a trouble-shoot option 601. Data relating to the diagnostic issue is provided to a user 603, allowing the user to better understand the problem and any steps that may need to be taken. One such step may include parking the vehicle. If a vehicle park is needed 605, the process may wait for the vehicle to be placed into park 607 before providing troubleshooting instructions 609.

In other examples, a non-driver occupant may be able to address the problem, or, for example, the problem may be addressable without parking the vehicle. In these instances, the troubleshooting instructions may be provided without waiting for the park state.

In some instances, the process may require that the user be outside a vehicle to address the issue 611. If the troubleshooting requires the user to be outside the vehicle 611, the process may provide an option to relay troubleshooting instructions to a mobile device 617. The device can then be carried outside the vehicle, where the troubleshooting can occur. If the relay option is selected 619, the process can relay appropriate (i.e., some or all) instructions to the mobile device 621. Typically, these will at least include the instructions that require action to be taken while outside the vehicle. Once the trouble-shooting has been completed 613 (indicated, for example, by a cessation of the warning state or, for example, a user indication that troubleshooting is complete, the process may return to display 615 of a normal state or, for example, the warning information, if the problem still exists.

Figure 7:
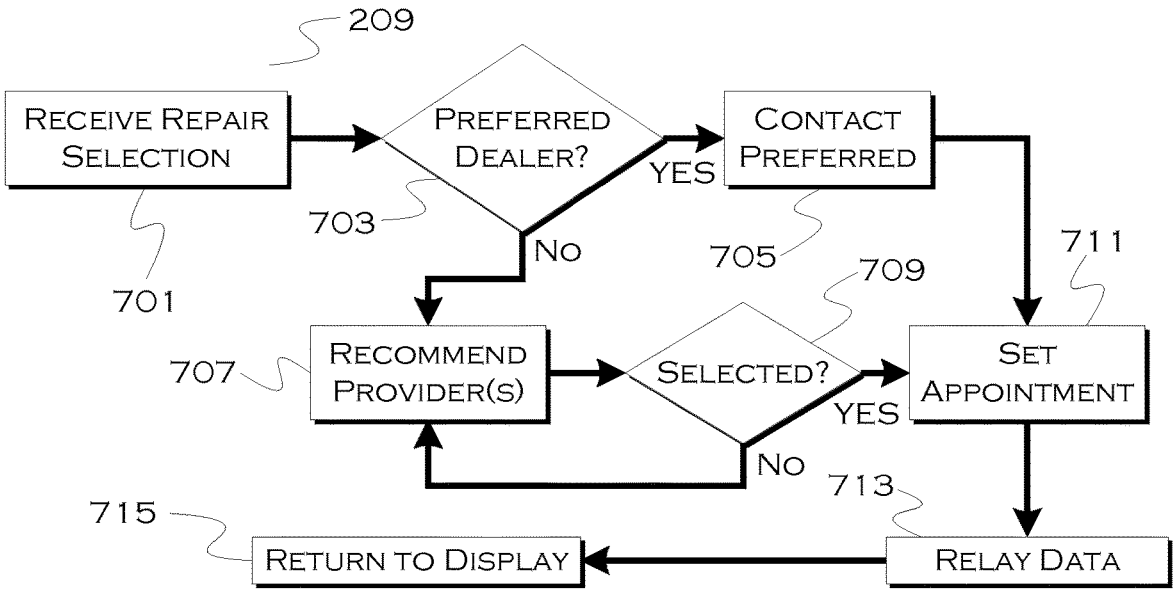
FIG. 7 shows an illustrative repair scheduling process.

FIG. 7 shows an illustrative repair scheduling process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this illustrative example, the user may have selected to have the issue associated with the warning light repaired. This may be because the user is not comfortable troubleshooting the problem, or, for example, because the problem may not be amenable to troubleshooting by the user. If the user selects the repair option 701, the process may check to see if a preferred dealer is associated with the vehicle 703. This could be, for example, the dealer that sold the vehicle to the user, or, for example, a user-specified dealer/mechanic that is typically used for repairs.

If there is a preferred dealer/mechanic, the process may contact (call, digitally communicate with, etc.) the preferred option 705. If there is no specified preferred option, then in this example, the process may recommend one or more providers 707 who can help with the identified problem. If one of these options is selected 709, the process can again contact the selected entity and set a service appointment for the user 711. Once set, the service appointment data can be relayed to the vehicle user 713, so the user knows when to drive to the appointment. The process can then return to the informational display 715, if appropriate, so that the user can take any other desired actions.

In order to assist with scheduling the appointment, in at least one example the process may communicate with both the user and a remote scheduling system to determine an appropriate appointment. A user can select an appointment from a presentation of available appointments, or select another repair facility if a present facility doesn't have a desirable appointment.

Figure 8:
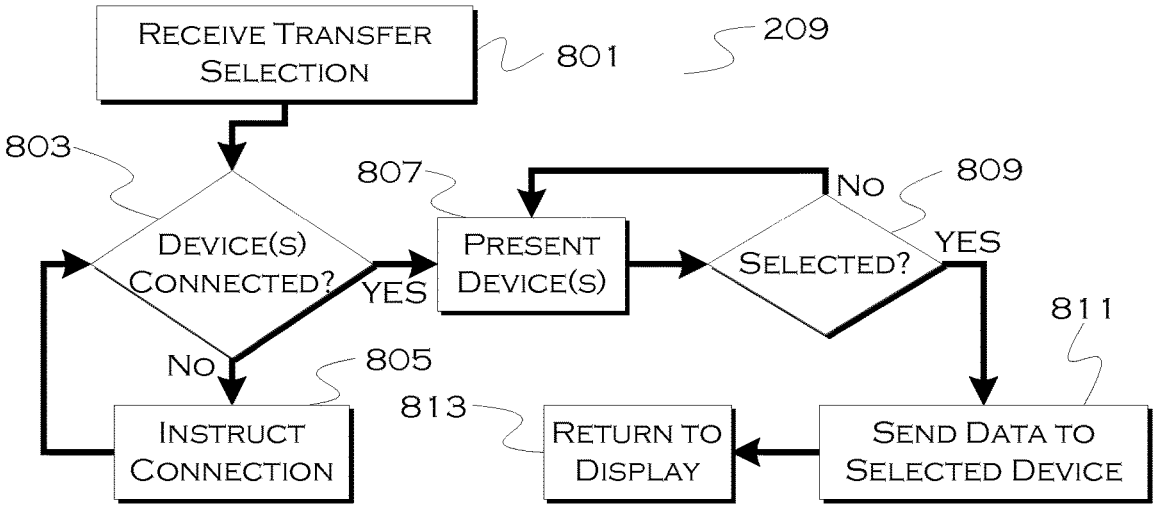
FIG. 8 shows an illustrative data transfer process.

FIG. 8 shows an illustrative data transfer process. With respect to the illustrative embodiments described in this figure, it is noted that a general purpose processor may be temporarily enabled as a special purpose processor for the purpose of executing some or all of the exemplary methods shown herein. When executing code providing instructions to perform some or all steps of the method, the processor may be temporarily repurposed as a special purpose processor, until such time as the method is completed. In another example, to the extent appropriate, firmware acting in accordance with a preconfigured processor may cause the processor to act as a special purpose processor provided for the purpose of performing the method or some reasonable variation thereof.

In this example, the user elects to transfer information relating to the problem to a mobile device in communication with the vehicle 801. In alternative options, the transfer can be done to a remote device (e.g., a PC or laptop) or other device not present in the vehicle (e.g., texted or digitally messaged to a mobile device, emailed, etc.).

In this example, the process determines if one or more devices are connected to the vehicle 803. Since the information is relayed directly from the vehicle to the device, the process here will instruct connection of a desired device 805 if no devices are connected. Then, in this example, the process will show a list of connected devices 807. If a device is selected 809 (or the process may automatically select a singly connected device), the process may send the relevant data relating to the problem causing the warning light to the connected device 811. Again, the process may then return to the display of warning light related information if appropriate, following the transfer process.

In at least one embodiment, the transfer of data to the mobile device will include a transfer of data to an application on the mobile device. In such an example, the process may present one or more applications running on a remote device, and allow selection of an application to which the data may be transferred. In another example, selection of an instruction to receive data on a mobile application may result in the application communicating with the vehicle to automatically request the data transfer.

Through use of the illustrative embodiments, user vehicular interaction can be improved, easily troubleshot problems can be addressed, and user experience can be improved by allowing the user to recognize the problems causing various warning lights.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system comprising:

a processor configured to:

detect a vehicle condition associated with a warning light;

obtain explanatory information explaining a warning-light cause;

present the explanatory information via a vehicle display;

present a data-transfer option in conjunction with the displayed explanatory information; and upon selection of the data-transfer option, transfer data, relating to a system causing the warning light, from a vehicle to a mobile device.

2. The system of claim 1, wherein the processor is configured to obtain the explanatory information from a remote source.

3. The system of claim 1, wherein the processor is configured to obtain the explanatory information from a local vehicular data store.

4. The system of claim 1, wherein the processor is configured to present a list of connected mobile devices, if more than one mobile device is in connected communication with the processor.

5. The system of claim 4, wherein the processor is configured to receive selection of one of the connected mobile devices, and transfer the data to the selected mobile device.

6. The system of claim 1, wherein the processor is configured to request connection of a mobile device if no devices are presently connected upon selection of the data-transfer option.

7. The system of claim 1, wherein the data relating to a system causing the warning light includes diagnostic information.

8. The system of claim 1, wherein the data relating to a system causing the warning light includes the explanatory information.

* * * * *